US006053102A

United States Patent [19]

Schönberger

[11] Patent Number: 6,053,102

[45] Date of Patent: Apr. 25, 2000

[54] CHAMBER DOCTOR WITH MEANS FOR MOVING DOCTOR BLADE

[75] Inventor: Wolfgang Schönberger, Neusäss, Germany

[73] Assignee: MAN Roland Durckmaschinen AG, Offenbach am Main, Germany

[21] Appl. No.: 08/799,044

[22] Filed: Feb. 10, 1997

[30] Foreign Application Priority Data

Feb. 9, 1996 [DE] Germany ..... 296 02 257 U

[51] Int. Cl.[7] ..... B41F 31/02

[52] U.S. Cl. ..... 101/364; 101/210; 101/350.1; 118/261; 118/413

[58] Field of Search ..... 101/157, 169, 101/207–210, 350.1, 350.2, 350.5, 350.6, 363, 364, 365–367, 3; 118/259, 261, 413

[56] References Cited

U.S. PATENT DOCUMENTS

| | | | |
|---|---|---|---|
| 2,377,110 | 5/1945 | Smith | 101/157 |
| 3,273,535 | 9/1966 | Krikorian | 118/405 |
| 4,009,657 | 3/1977 | Bonanno et al. | 101/157 |
| 5,117,752 | 6/1992 | Micheli | 101/207 |
| 5,345,867 | 9/1994 | Schneider et al. | 101/363 |
| 5,642,664 | 7/1997 | Schneider | 101/123 |
| 5,749,293 | 5/1998 | Ota et al. | 101/157 |

FOREIGN PATENT DOCUMENTS

| | | |
|---|---|---|
| 294 022 | 12/1988 | European Pat. Off. . |
| 257802 | 6/1988 | Germany . |
| 4213663 | 3/1993 | Germany . |
| 4138807 | 6/1993 | Germany . |
| 44 25 478 | 2/1996 | Germany . |
| 4425478 | 2/1996 | Germany . |
| 1222700 | 2/1971 | United Kingdom . |

*Primary Examiner*—John S. Hilten
*Assistant Examiner*—Dave A Ghatt
*Attorney, Agent, or Firm*—Cohen, Pontani, Lieberman & Pavane

[57] ABSTRACT

A chamber doctor for inking a cylinder in a printing machine, which cylinder has depressions for receiving ink. The chamber doctor includes a chamber doctor body, at least one doctor blade, and lateral side parts, the chamber doctor body, the at least one doctor blade and the side parts being arranged to define an ink chamber that is open toward the cylinder. The doctor blade is movably supported at the chamber doctor body. The doctor blade is movable relative to the chamber doctor body so that the doctor blade is automatically readjusted to compensate for wear, and further so that parts of the doctor blade and chamber doctor body which come into contact with ink are movable away from one another.

14 Claims, 4 Drawing Sheets

CHAMBER DOCTOR WITH MEANS FOR MOVING DOCTOR BLADE

BACKGROUND OF THE INVENTION

1. Field of the Invention

The invention is directed to a chamber doctor for inking a cylinder in a printing machine. The cylinder has depressions in its surface for receiving ink. The cylinder can, for example, be a gravure printing, cylinder or a screening roller of a short inking mechanism.

2. Description of the Prior Art

German reference DE 44 25 478 A1 shows a chamber doctor for inking a cylinder in a printing machines which cylinder has depressions for receiving ink. The chamber doctor has doctor blades which adjust automatically to the cylinder depending on wear. In this connection, the doctor blades execute a rotating movement, for which purpose they must be scaled from the chamber doctor body which is stationary relative to the doctor blades, since they form part of the ink chamber. The sealing is effected by a contact seal or in a noncontacting manner as a gap seal. The sealing location is wetted by printing ink which cools during breaks in printing and accordingly becomes viscous. When printing stops for longer periods, e.g., after a day's work, the ink usually dries. The automatic adjustment of the doctor blade is accordingly slowed down or even stopped. As a result, the surface of the inked roller is not wiped clean and too much ink is transferred to the following rollers. This problem can not be solved by increasing the doctor blade adjusting forces since it is not possible to achieve consistent adjusting pressure depending on the degree of stickiness. Moreover a high adjusting force increases wear on the cylinder to be wiped and on the doctor blade. There is also a risk that the doctor blade will buckle.

Another chamber doctor is disclosed in DE 42 13 660 C2. This reference teaches a chamber doctor in which the working doctor blade and the closing doctor blade are each received in a longitudinal slot of the chamber doctor body so as to be displaceable. The blades are pressed by springs against the inked cylinder. Ink penetrates into the guide gap between the doctor blade and the chamber doctor body and completely fills the longitudinal slot. The ink gums up the doctor blades leading to the aforementioned problems.

SUMMARY OF THE INVENTION

Accordingly, it is an object of the present invention to provide a chamber doctor in which ink is prevented from gumming up the parts of the doctor blade and chamber doctor body which are movable relative to one another.

Pursuant to this object and others which will become apparent hereafter, one aspect of the present invention resides in a chamber doctor having a chamber doctor body, at least one doctor blade, and lateral side parts. The chamber doctor body, the at least one doctor blade and the side parts are arranged to define an ink chamber that is open toward the cylinder of a printing machine. Means are provided for removably supporting the doctor blade at the chamber doctor body. Furthermore, means are provided for moving the doctor blade relative to the chamber doctor body so that the doctor blade is automatically readjusted to compensate for wear and further so that parts of the doctor blade and chamber doctor body which come into contact with ink are removable away from one another.

In another embodiment of the invention sealing means are provided that have an element attached to the doctor blade and a further element attached to the chamber doctor body so that the elements cooperate to form a seal and further so that the elements are movable away from one another.

In yet another embodiment of the invention the means for moving the doctor blade includes at least one force element configured and arranged to exert a force to move the doctor blade toward the cylinder when the chamber doctor is backed off from the cylinder, so as to separate the sealing elements.

In another embodiment of the invention the moving means includes at least one force element configured and arranged to exert a force to move the doctor blade away from the cylinder, so as to separate the sealing elements.

As a result of the possibility of backing off, a distance can be maintained between the doctor blade and the sealing and guiding elements during printing stoppages such that the ink which would otherwise remain in the gap locations due to capillary forces is able to flow off. Drainage possibilities are also created for ink puddles. Since the opening of the contact locations and gap locations is advantageously effected immediately after printing the ink which is still warm and relatively free-flowing at this stage can flow off easily. The chamber doctor can now remain in this state as long as desired without the doctor blade readjusting elements becoming glued together.

The various features of novelty which characterize the invention are pointed out with particularity in the claims annexed to and forming a part of the disclosure. For a better understanding of the invention, its operating advantages and specific objects attained by its use, reference should be had to the drawing and descriptive matter in which there are illustrated and described preferred embodiments of the invention.

DETAILED DESCRIPTION OF THE PREFERRED EMBODIMENTS

Figure 1A:
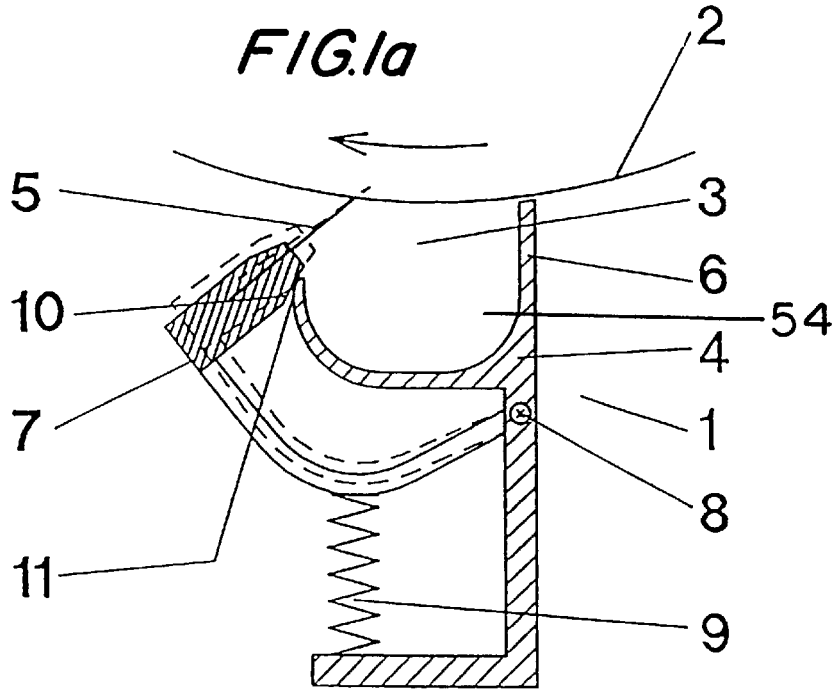
FIGS. 1*a* and 1*b* show a first embodiment of the chamber doctor pursuant to the present invention.
Figure 1B:
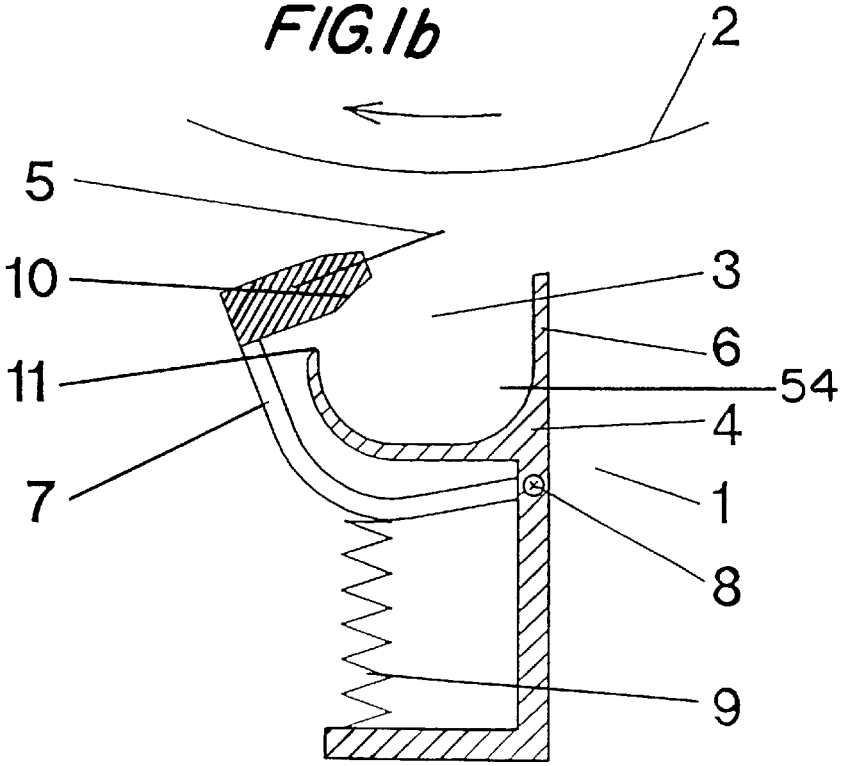

FIGS. 1*a* and 1*b* show a chamber doctor 1 which is adjustable against an inked cylinder 2. This cylinder 2 has depressions which receive ink. The cylinder 2 can be a screening roller of an inking mechanism of a printing machines for example. The chamber doctor 1 has an ink chamber 3 which is open toward the cylinder 2. The ink chamber 3 is defined by a chamber doctor body 4, a working doctor blade 5, a closing strip 6 arranged at a distance from the cylinder 2, and lateral side parts. The side parts can be formed as sheet-metal parts and can rest on the end faces of the working doctor blade 5 and the closing strip 6. However they can also be formed by walls of the chamber doctor body 4. The working doctor blade 5 could also project beyond the side parts and rest upon the latter during continued movement in the direction of its plane. However, this is not the subject of the invention and is therefore not described in more detail here or in the following examples.

The working doctor blade 5 is fastened to a holder 7 which is supported at the chamber doctor body 4 by bearing, pins 8. The holder 7 is acted upon by the force of a pressure spring 9 supported at the chamber doctor body 4 so that the working doctor blade 5 is pressed against the cylinder 2 and readjusted according to wear. A readjusted position is shown in dashed lines in FIG. 1*a*. The holder 7 has a sealing surface 10 and, together with a sealing edge 11 of the chamber doctor body 4, forms a gap seal. The gap is approximately 0.1 to 1.0 mm. The gap seals are similarly dimensioned in the following examples. The sealing surface 10 is advantageously curved with the radius around the swivel point of the holder 7 (bearing pin 8), so that the gap width is maintained constant during swiveling. FIG. 1*a* shows the chamber doctor 1 contacting the cylinder 2. The chamber doctor 1 is filled with ink and inks the rotating cylinder 2.

FIG. 1*b* shows the chamber doctor 1 in its backed off position. Means for moving away the chamber doctor are not the subject of the present invention and are therefore not shown. In this position the pressure spring 9 swivels the holder 7 upward into the illustrated position because the working doctor blade 5 is no longer resting on the cylinder 2 and does not offer any opposing force to the force of the pressure spring 9. During this swiveling movement of the holder 7 the sealing surface 10 and the scaling edge 11 move apart and open the gap seal. These sealing elements are accordingly spaced apart and cannot become stuck together and the ink located thereon can run off.

Figure 2A:
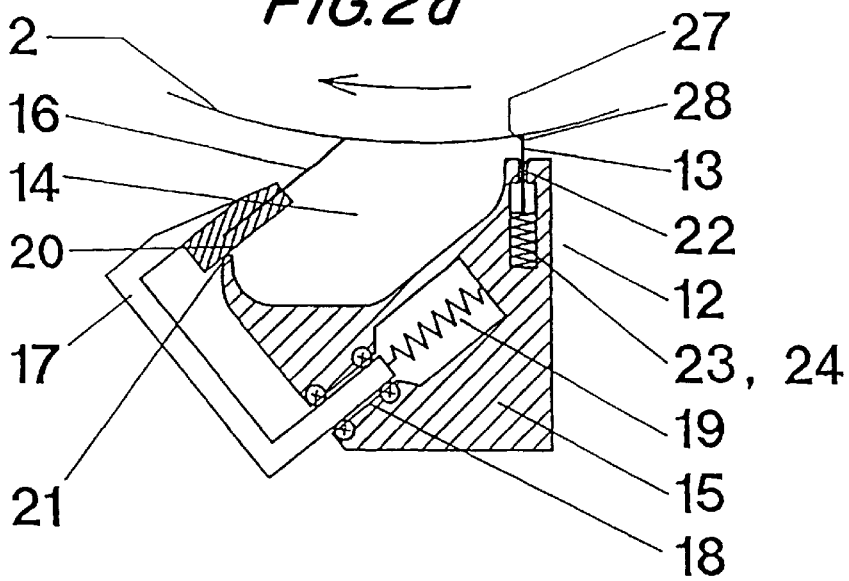
FIGS. 2*a*–2*c* show a second embodiment of the inventive chamber doctor.

The following examples show other possible variants for moving away the doctor blade as well as other constructions of the chamber doctor. The chamber doctor 12 according to FIGS. 2*a* and 2*b* has a closing doctor blade 13 instead of a closing strip 6 as in FIGS. 1*a* and 1*b*. The ink chamber 14 is further defined by a chamber doctor body 15 and a working doctor blade 16. Regarding the side parts, not shown, in order to avoid repetition reference is had to the above description referring to FIG. 1. Also, for the sake of simplicity, the cylinder will still be designated by reference number 2. The holder 17, which accommodates the working doctor blade 16, is movable in a straight line by a straight-line guide 18 of the chamber doctor body 15. Tension springs 19 are attached to the chamber doctor body 15 and the holder 17 and pull the working doctor blade 16 against the cylinder 2. The holder 17 has a planar sealing surface 20 which, together with a sealing edge 21 of the chamber doctor body 15, forms a gap seal. The closing doctor blade 13 is inserted into a longitudinal slot 22 of the chamber doctor body 15 and is pressed against the cylinder 2 by pressure springs 23, 24 supported at the base of the longitudinal slot 22.

Figure 2B:
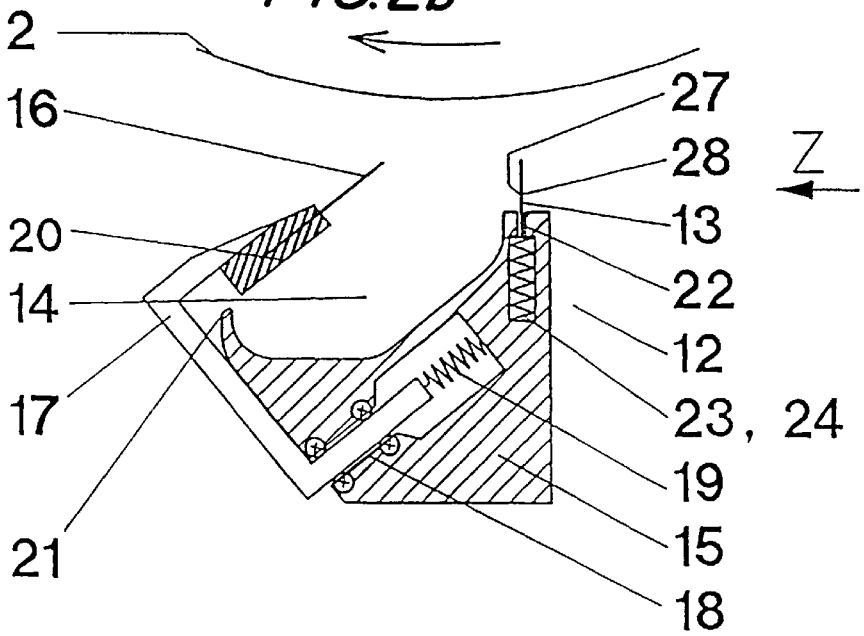
Figure 2C:
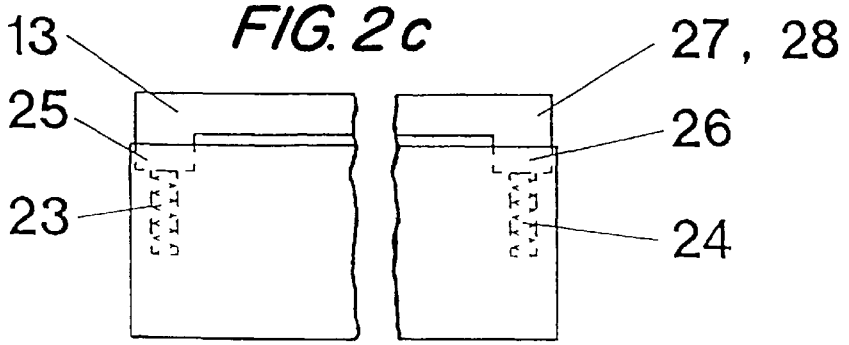

When the chamber doctor 15 is moved away from the cylinder 2 (FIG. 2*b*), the working doctor blade 16 and the closings doctor blade 13 can no longer rest against the cylinder 2. Consequently the tension spring 19 draws in the holder 17 and the sealing surface 20 is moved away from the sealing edge 21. It has already been described with reference to FIG. 1 how the ink now runs off from sealing elements so that such a description need not be repeated here and in the following embodiments. The closing doctor blade 13 which is likewise freed from the cylinder 2 is pushed out of the longitudinal slot 22 by the action of the pressure springs 23, 24 so that it is now guided therein only by lateral holding webs 25, 26 (FIG. 2*c* in direction Z of FIG. 2*b*). The guide surfaces 27, 28 of the closing doctor blade 13 are cut out or recessed between the holding webs 25, 26 so that the moved out guide surfaces 27, 28 cannot become glued into the longitudinal slot 22 by the ink.

Figure 3A:
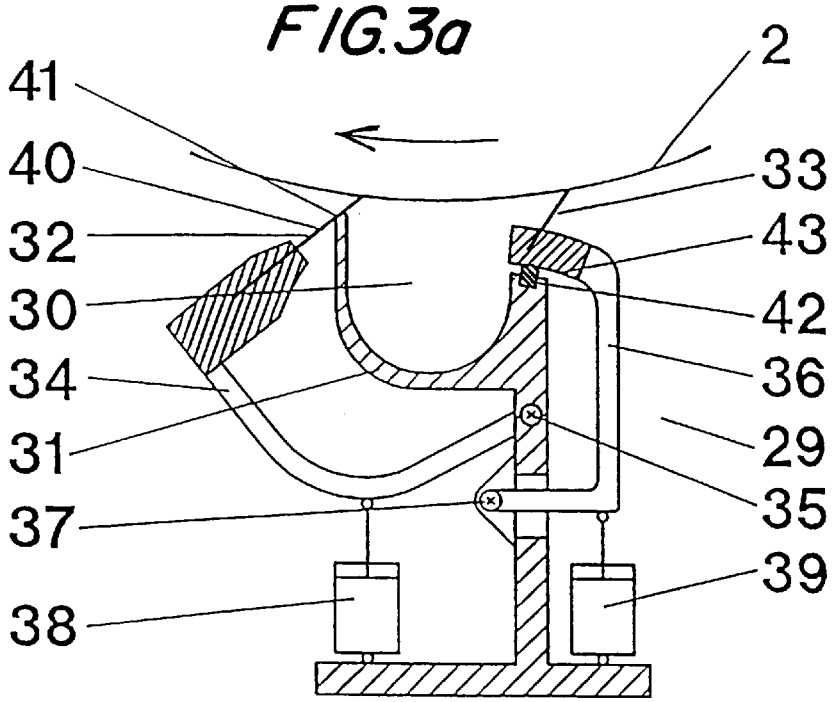
FIGS. 3*a* and 3*b* show a third embodiment of the inventive chamber doctor.
Figure 3B:
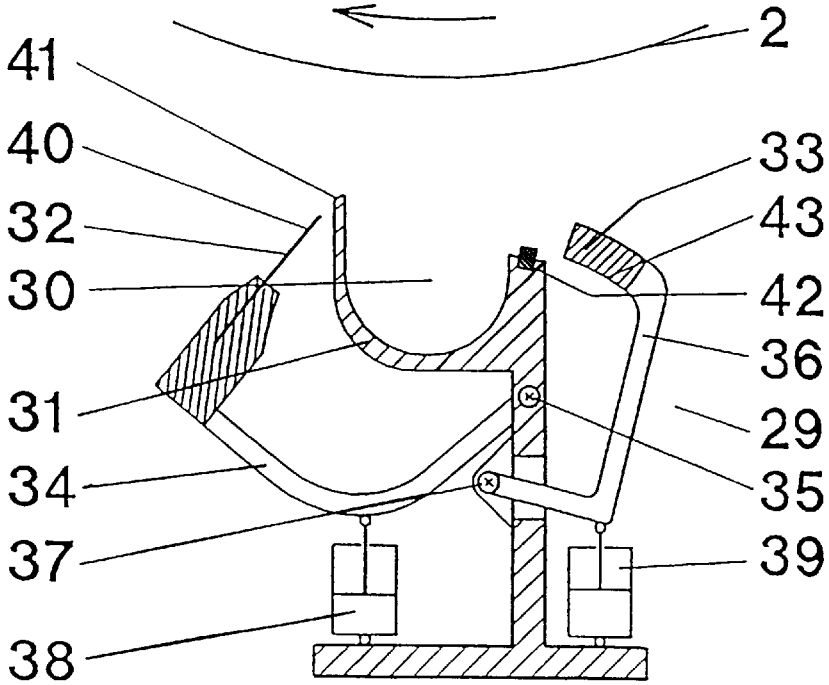

FIGS. 3*a* and 3*b* show a chamber doctor 29 having an ink chamber 30 defined by a chamber doctor body 31, a working doctor blade 32 and a closing doctor blade 33. The working doctor blade 32 is fastened to a holder 34 which is swivelably supported at the chamber doctor body 31 by bearing pins 35. The closing doctor blade 33 is received in a holder 36 which is likewise swivelably supported at the chamber doctor body 31 by bearing pins 37. In this embodiment, the working doctor blade 32 and the closing doctor blade 33 are pressed against and readjusted toward the inked cylinder 2 by work cylinders 38, 39. For this purpose, the work cylinders 38, 39 act at the holders 34, 36 and rest against the chamber doctor body 31. In this instance, a side surface of the working doctor blade 32 serves as a sealing surface 40 which forms a gap seal together with a sealing edge 41 of the chamber doctor body 31. In order to seal the holder 36 relative to the chamber doctor body 31, a seal 42 which works together with a sealing surface 43 of the holder 36 is recessed into the chamber doctor body 31. The sealing surface 43 advantageously has a curvature with the radius around the swivel point of the holder 36 (bearing pin 37).

In this embodiment, the chamber doctor 29 need not be moved away from the inked cylinder in order to move back the parts of the chamber doctor 29 which are at risk of sticking. This can be achieved by a signal which reverses the work cylinders 38, 39. The piston rods of the work cylinders 38, 39 retract and swivel the holders 34, 36 into the position shown in FIG. 3*b*. The sealing surface 40 of the working doctor blade 32 is now moved away from the sealing edge 41. Furthermore, the sealing surface 43 of the holder 36 is swiveled away from the seal 42. FIG. 3*b* shows the position of the chamber doctor 29 when it is moved away from the cylinder 2. It goes without saying that work cylinders can also be used to actuate a holder when the holder carries the scaling surface cooperating with the sealing edge of the chamber doctor body or if the holder is moved in a straight line. In the latter case, such a work cylinder would have to be placed in the chamber doctor body 15. e.g., instead of the tension springs 19 in FIGS. 2*a*, 2*b*. The work cylinders 38, 39 can be hydraulic or pneumatic. Electrical lifting magnets, for example, can also be used in place of work cylinders 38, 39. In the latter case, tension springs can be mounted on the holders 34, 36 should their force of gravity not be sufficient for the backing off movement.

Figure 4A:
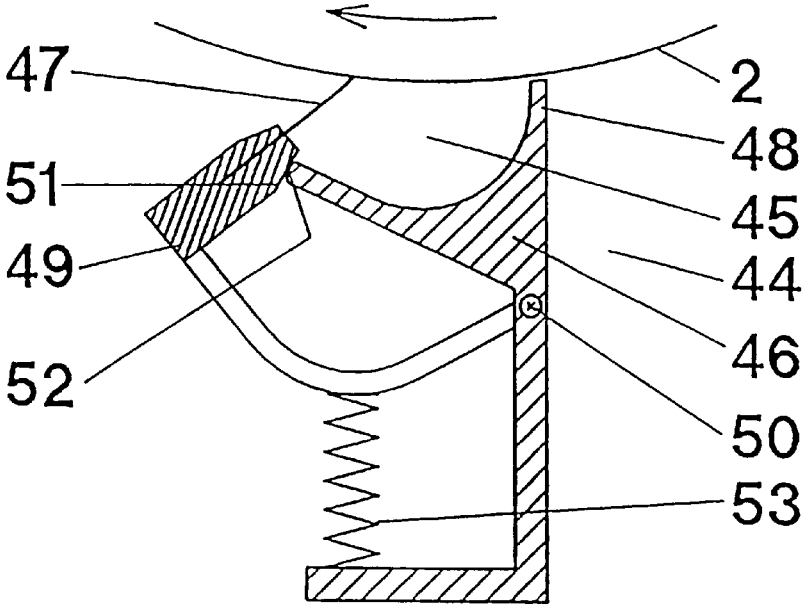
FIGS. 4*a* and 4*b* show a fourth embodiment of the inventive chamber doctor.
Figure 4B:
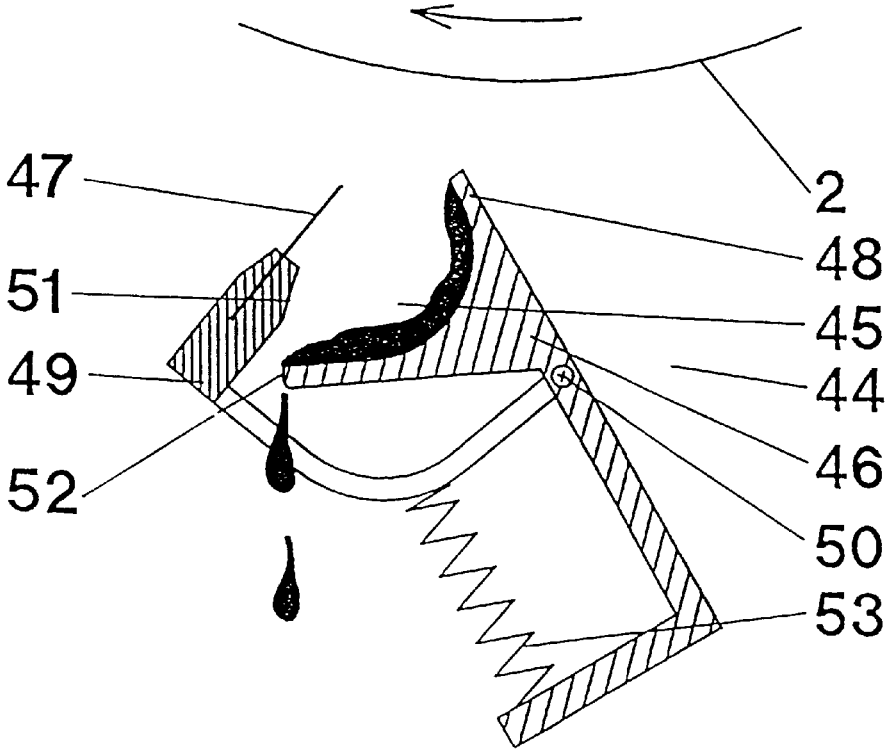

FIGS. 4*a* and 4*b* show a chamber doctor 44 whose ink chamber 45 is defined by a chamber doctor body 46, a working doctor blade 47, and a closing strip 48. The working doctor 47 blade is fastened to a holder 49 which is swivelably supported at the chamber doctor body 46 by bearing pins 50. The holder 49 is sealed relative to the chamber doctor body 46 by means of a gap seal formed by a sealing surface 51 of the holder 49 and a sealing edge 52 of the chamber doctor body 46. The working, doctor blade 47 is pressed against the inked cylinder 2 by a force applied via the holder 49 by a pressure spring 53 supported at the chamber doctor body 46.

As in the embodiment according to FIGS. 1*a* and 1*b* when the chamber doctor 44 is moved away from the cylinder 2 accompanied by a swiveling movement of the holder 49 triggered by the pressure spring 53, the sealing surface 51 is moved away from the sealing edge 52 and in so doing the gap between these two parts is opened. In addition to this, however, the backing off movement of the chamber doctor 44 away from the cylinder 2 involves a swiveling movement such that the sealing edge 52 occupies the lowest point of the ink chamber 45. The tilting can be carried out by a corresponding movement of the chamber doctor bar, not shown, on which the chamber doctor 44 is mounted. Tilting is obviated when the ink chamber 13 is designed so that the sealing edge 52 lies at the lowest point of the ink chamber 13. In the position shown in FIG. 4*b*, the ink chamber 45 empties out completely. This has a certain self-cleaning effect. It is further advantageous that no ink is lost when the chamber doctor 45 is disassembled, since the ink runoff is collected in an ink pan and returned to the ink fountain.

As was already indicated, the doctor blade, sealing and actuating variants indicated above by way of example can be combined in any desired manner.

Other objects and features of the present invention will become apparent from the following detailed description considered in conjunction with the accompanying drawings. It is to be understood, however, that the drawings are designed solely for purposes of illustration and not as a definition of the limits of the inventions for which reference should be made to the appended claims.

I claim:

1. A chamber doctor for inking a cylinder in a printing machine, which cylinder has depressions for receiving ink, the chamber doctor comprising: a chamber doctor body; at least one doctor blade; lateral side parts, the chamber doctor body, the at least one doctor blade and the side parts being arranged to define an ink chamber that is open toward the cylinder; means for movably supporting the doctor blade at the chamber doctor body; means for moving the doctor blade relative to the chamber doctor body so that the doctor blade is automatically readjusted to compensate for wear, and further so that parts of the doctor blade and chamber doctor body which come into contact with ink are movable away from one another; and sealing means having an element attached to the doctor blade and a further element attached to the chamber doctor body, the elements cooperating to form a seal and being moveable away from one another.

2. A chamber doctor according to claim 1, wherein the moving means is operative to move the sealing elements away from one another for readjustment of the doctor blade.

3. A chamber doctor according to claim 2, wherein the supporting means swivelably supports the doctor blade at the chamber doctor body.

4. A chamber doctor according to claim 3, wherein the moving means includes at least one force element configured and arranged to exert a force to move the doctor blade toward the cylinder, during a backing off movement of the chamber doctor from the cylinder, so as to separate the sealing elements.

5. A chamber doctor according to claim 3, wherein the moving means includes at least one force element configured and arranged to exert a force to move the doctor blade away from the cylinder so as to separate the sealing elements.

6. A chamber doctor according to claim 3, wherein the chamber doctor is configured so that the sealing element occupies a lowest point of the ink chamber.

7. A chamber doctor according to claim 2, wherein the supporting means displaceably supports the doctor blade at the chamber doctor body.

8. A chamber doctor according to claim 7, wherein the moving means includes at least one force element configured and arranged to exert a force to move the doctor blade toward the cylinder, during a backing off movement of the chamber doctor from the cylinder, so as to separate the sealing elements.

9. A chamber doctor according to claim 7, wherein the moving means includes at least one force element configured and arranged to exert a force to move the doctor blade away from the cylinder so as to separate the sealing elements.

10. A chamber doctor according to claim 9, wherein the doctor blade has at least two holding webs that project beyond the guide surfaces, the moving means including force elements arranged to act on the holding webs so that when the chamber doctor is moved away from the cylinder so that the guide surfaces of the doctor blade exit from the longitudinal slot and the doctor blade is held in the longitudinal slot only by the two holding webs.

11. A chamber doctor according to claim 1, wherein the doctor blade has guide surfaces, the chamber body having a longitudinal slot with side faces, the guide surface of the doctor blade being displaceably supported between the side faces of the slot so that the guide surfaces and side faces can be moved away from one another.

12. A chamber doctor according to claim 1, wherein the doctor blade is a working doctor blade.

13. A chamber doctor according to claim 1, wherein the doctor blade is a closing doctor blade.

14. A chamber doctor for inking a cylinder in a printing machine, which cylinder has depressions for receiving ink, the chamber doctor comprising: a chamber doctor body; at least one doctor blade; lateral side parts, the chamber doctor body, the at least one doctor blade and the side parts being arranged to define an ink chamber that is open toward the cylinder; means for movably supporting the doctor blade at the chamber doctor body; and means for moving the doctor blade relative to the chamber doctor body so that the doctor blade is automatically readjusted to compensate for wear, and further so that parts of the doctor blade that come into contact with ink are movable away from parts of the chamber doctor body which come into contact with ink so as to form a gap between the parts.

* * * * *